US005318155A

United States Patent [19]

Alder et al.

[11] Patent Number: 5,318,155

[45] Date of Patent: Jun. 7, 1994

[54] DISK BRAKE FOR TEXTILES

[75] Inventors: Günter Alder, Viersen; Hans Theihsen, Mönchengladbach; Hubert Kremer, Grefrath, all of Fed. Rep. of Germany

[73] Assignee: Hacoba Textilmachinen GmbH & Co., KG, Wuppertal, Fed. Rep. of Germany

[21] Appl. No.: 934,370

[22] Filed: Aug. 21, 1992

[30] Foreign Application Priority Data

Aug. 22, 1991 [DE] Fed. Rep. of Germany ... 9110404[U]

[51] Int. Cl.[5] ..... B65H 59/20

[52] U.S. Cl. ..... 188/65.1; 66/146

[58] Field of Search ..... 188/65.1-65.5, 188/83, 84, 382; 66/146

[56] References Cited

U.S. PATENT DOCUMENTS 2,264,069 11/1941 Cloutier ..... 66/146

3,146,969 9/1964 Lindsey ..... 66/146

3,575,360 4/1971 Lawson ..... 66/146

4,209,881 7/1980 Blore ..... 66/146

4,706,476 11/1987 Memminger et al. ..... 66/146

4,821,199 4/1989 Kuhnert ..... 66/146

*Primary Examiner*—Matthew C. Graham

*Attorney, Agent, or Firm*—O'Keefe & Wilkinson

[57] ABSTRACT

A disk brake for textile yarns is mounted upon a horizontal brake support for a warp creel with the disk axis disposed perpendicularly to the brake support. The upper disk can be adjustably loaded for adjusting the braking force. The entire adjustable range of the brake can be controlled with a single spring, which is below the horizontal brake support. The brake spring is disposed parallel to the brake support and is attached at one end preferably to an adjuster that can be shifted relative to the brake support and at the other end to a pivoting lever arm which presses vertically downwardly on the upper disk under the influence of the brake spring.

28 Claims, 3 Drawing Sheets

A

DISK BRAKE FOR TEXTILES

The invention is related to a disk brake for textile yarns, with a disk axis disposed perpendicularly to a horizontal brake support of a warp creel and with an upper disk, which can be adjustably loaded for adjusting the braking force.

A known disk brake with the aforementioned characteristics consists of two weight-loaded disks, the disk axis of which is fastened to a bearing plate that carries looping pins for a textile yarn, which are parallel to the axis of the disk and with which the yarn tension is preadjusted. Such a disk brake does not satisfy the requirements with respect to the rapid and accurate adjustments of the yarn tension, particularly not if tensions must be changed at a plurality of disk brakes of a warp creel.

Disk brakes with vertical brake supports are known, for which the upper disk can be spring-loaded for adjusting the braking force. The compression spring, which produces the spring force, is disposed coaxially with the disk axis. One end of this compression spring is supported on the upper disk, while the other end can be adjusted more or less in the direction of the disk axis by an adjusting element, in order to adjust the braking force. The known disk brake is built into the cavity of the brake support, which is constructed as an open, hollow profile. The brake support is therefore dimensioned disproportionately large in cross section and must be designed specifically for guiding yarns.

It is therefore an object of the invention to improve a disk brake with the initially named characteristics, so that the whole of the relevant adjusting range of the brake can be controlled with a single spring, the construction being matched to the horizontal brake support.

This objective is accomplished owing to the fact that, below the horizontal brake support, a brake spring is disposed, which is parallel to the brake support and engages, on the one hand, the brake support or an adjuster that can be shifted relative to the brake support and, on the other hand, a lever arm of a pivotable, stationary reversing lever, which presses vertically on the upper disk under the influence of the brake spring.

The specially adapted use of the brake spring, namely the use as a brake spring parallel to the support, is of importance for the invention. This use of the brake spring outside of the axis of the disk is a prerequisite for being able to vary the load on the upper disk to a considerable greater extent. Due to the use of the pivotable, stationary reversing lever, the braking force or the load on the upper disk can be adjusted using the lever laws. At the same time, the arrangement of the brake spring parallel to the brake support enables the adjusting unit of the disk brake to be arranged in a space-saving fashion with respect to the warp creel. Moreover, the disk brake can be constructed independently of the arrangement of the horizontal brake support.

Advantageously, the disk brake is constructed so that the reversing lever is a 2-arm lever, one arm of which is engaged by the brake spring and the other arm of which is angular and presses with one end over a contacting device on the upper disk. The construction of the reversing lever as a 2-arm lever brings about, in particular, structural freedom for the arrangement of the disk brake and, at the same time, for the selection of the adjusting range of the braking force. The contacting device makes possible the required adaptations in the region between the end of the lever arm and the upper disk.

In order to be able to adapt the disk brake to several braking force ranges using a single brake spring, without having to have a special structural expenditure for this, such as another reversing lever, the disk brake is constructed so that one arm of the reversing lever protrudes with clearance to move through a recess of the brake support as far as into the region of the brake spring that is parallel to the support and has several spring engagement sites there. To adjust the brake force range, it is thus merely necessary to allow the brake spring to act at the respectively desired spring engagement site. This can be achieved in a particularly simple manner by suspending the brake spring, if the brake spring, which is parallel to the support, is a tension spring. Aside from re-suspending the brake spring, no other measure is required to change the brake force range of the disk brake. The disk brake can be so designed for this purpose, that the brake spring is suspended with one end in a notch of the arm of the reversing lever and, with the other end, at an adjusting ring, which is clamped fast to the adjuster, which is constructed as a rod parallel to the support. By these means, the disk brake becomes suitable for a central adjustment, for which the adjuster, which is constructed as a rod parallel to the support and has several adjusting rings, can engage correspondingly many brake springs of several disk brakes.

In comparison to a compression spring, the tension spring has the advantage of not requiring a radial guide, which leads to an adverse effect on the effective braking force.

So that it can be mounted largely in the preassembled state on the brake support, the disk brake is designed so that the disk axis is combined with the reversing lever into one structural unit, which is mounted on the brake support. This is of advantage not only for assembling the disk brake together with the brake support, but also for dismantling the disk brake in the event that a component is defective. In this case, the whole of the physical unit can simply be exchanged for a new one, which decreases the down time of the warp creel. In particular, the physical unit is constructed by using the swivel pin of the reversing lever, the ends of which swivel pin engage a radial slot of a bearing plate of the disk axis, to connect the disk axis with the reversing lever into a physical unit.

So that the bearing plate does not have to be fitted in a complicated manner to the structural realities of the brake support, the disk brake is designed so that the bearing plate lies on a mounting plate, which can be assembled with the brake support and has yarn guides, which are kept level with the disk gap.

Insofar as it is necessary to drive the disk brake, that is, to set at least one disk in rotational motion in order to remove yarn abrasion and to prevent incisions in the disk pair, the disk brake is constructed so that the bearing plate has a rotationally symmetrical bearing recess for an axially supported bearing shaft, which carries the lower disk coaxially and passes with one end of the shaft through the brake support, which has a traversing rod, which is parallel to the support and engages the shaft end. The bearing shaft is thus driven back and forth, so that lint and similar material abraded from the yarns cannot collect in the region of the disks, as would be the case with stationary disks or with disks driven in a revolving fashion.

The bearing shaft supports the lower disk axially displaceably with a flexible ring, so that slight axial motions of the lower disk become possible, for example, in order to permit a knot in the yarn to pass. On the other hand, the flexibility is limited, in order to be able to press the upper disk onto the yarn with the required pressure.

If also the upper disk is to be driven, the disk brake is constructed so that the bearing shaft has a spring, which engages the upper disk through a central recess in the lower disk. The spring enables the upper disk to be driven synchronously. Furthermore, it makes a limited, relative, rotational displacement of the two disks possible, which is useful for their assembly and for the maintenance of the disk brake, by means of, however, the normal operation of the disk brake is also favored by the avoidance of malfunctions. This is the case particularly when the spring is a piece of wire, the one end of which is ring-shaped and inserted in a circumferential groove of the bearing shaft, and the other end of which protrudes parallel to the axis up to the upper disk, which has one or several recesses for engaging a radial section of the other end of the piece of wire.

If the upper disk is rigidly connected to a pressure plate, which is engaged by a rotationally mobile pressure pin, which is fastened to the end of the other arm of the reversing lever, then this refinement favors, on the one hand, the arrangement of a large central recess of the upper disk for engaging a wire end of the driving spring and, on the other hand, enables pressure, which permits relative motions, to be applied by means of the reversing lever.

For fine adjustments, the disk brake is constructed so that the length of the pressure pin can be adjusted.

If the bearing plate encompasses the outside of the lower disk up to about the height of the disk gap, then this results in a closed view, which hides the details of the disk brake and is associated with further structural design possibilities. For example, the disk brake can be constructed so that the bearing plate has at its outer periphery a recess, which makes the lower disk laterally accessible. Aside from serving for manipulation purposes at the lower disk, such a recess can be of use for cleaning the disk brake.

Moreover, it is possible to configure the disk brake so that the bearing plate has at its outer circumference, at least in the region intended by the yarn guides, a yarn sliding surface, which extends up to the vicinity of the mounting plate. This is particularly advantageous for preventing entanglements of the yarn in the region of the disk brake. When a slack yarn is tensioned once again upon restarting warping or beaming, it can readily be pulled on the yarn sliding surface into the disk gap.

The invention is explained by means of an embodiment shown in the drawing, in which

DETAILED DESCRIPTION OF DRAWINGS

Figure 2:
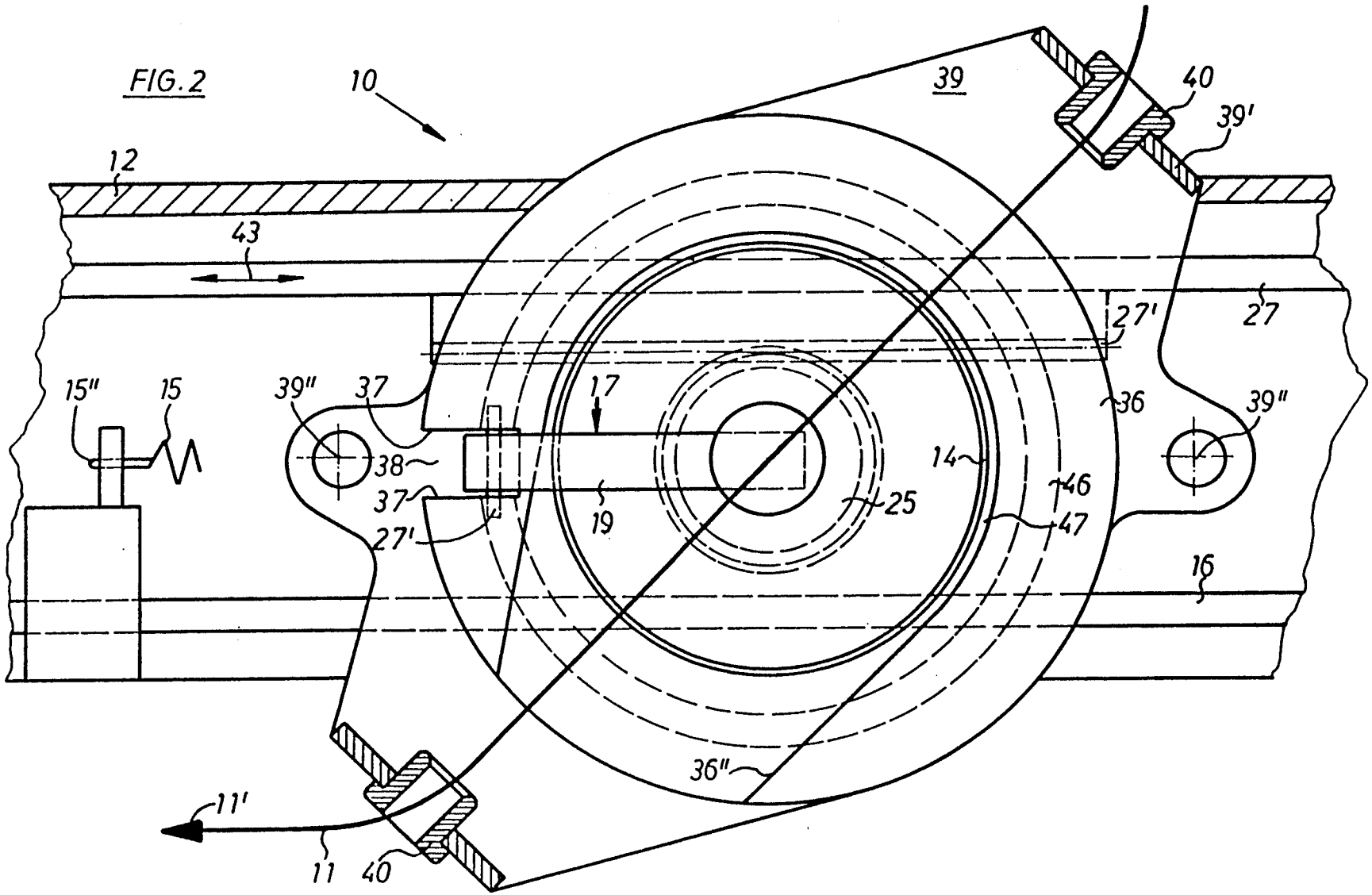
FIG. 2 shows a plan view of the disk brake of FIG. 1.

The yarn 11, shown in FIG. 2, is drawn off by a winding machine, for example, a warping machine or a beamer, from a bobbin (not shown) of a warp creel in the direction of the arrow 11'. At the same time, the yarn 11 passes through the disk brake 10, which imparts the yarn tension that is necessary for the winding up. The disk brake 10 has an upper disk 14, which lies on a lower disk 26. The two form the disk gap 35 with the visible flattenings. The yarn 11 is pulled through the disk gap 35 into and through the disk brake 10.

The disks 14, 26 are disk-shaped, sheet-metal pressed parts, the outer disk edges of which point parallel to a center line 41 up or down. In addition, the disks 14, 26 have inner recesses 14' 26', which are formed by the inner edges that are parallel to the outer edges, so that the disks 14, 26 actually are ring-shaped.

Figure 3:
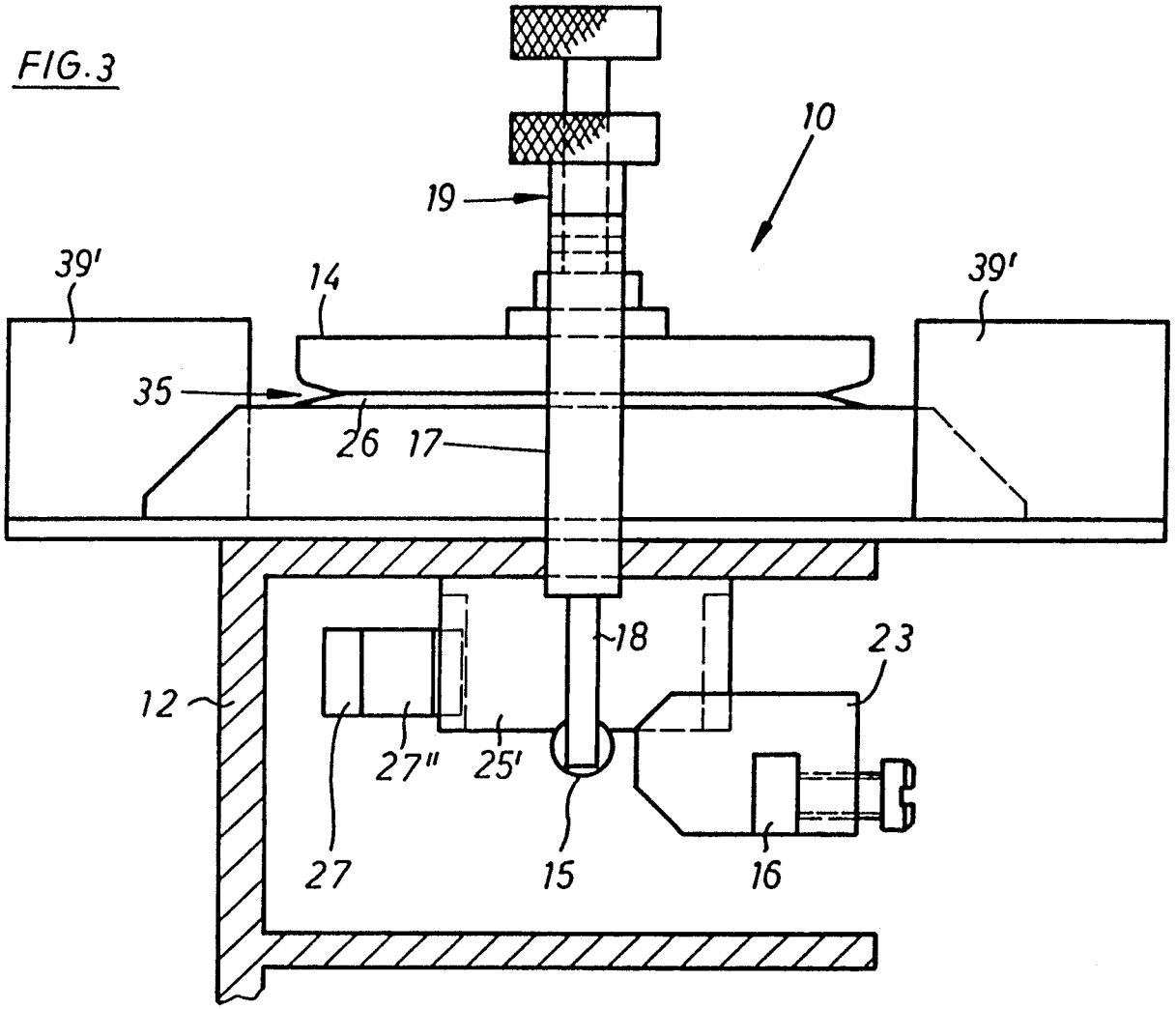
FIG. 3 shows a side view of the disk brake of FIG. 1 in the direction A.

A disk brake 10 is disposed with its disks 14, 26 on a horizontally extending brake support 12, which has, according to FIG. 3, the F-shaped cross section shown there by way of example. Above this brake support 12 or lying directly upon it, a mounting plate 39 is provided, which carries yarn guides 40 with offsets 39'. The yarn guides 40 are disposed at the height of the disk gap 35 and, as a result of the opposite arrangement shown in FIG. 2, fix the region, in which the yarn 11 passes through the yarn brake 10. At places 39'', the mounting plate 39 is screwed, or fastened, together with the brake support 12.

The mounting plate 39 carries a disk axis, or axial alignment support assembly, 13 for supporting the disks 14, 26. The support is brought about with a flexible ring 28, such as a foamed material ring. Consequently, the lower disk 26 can give way downwards, in the event that a knot in the yarn 11 is passing through. On the other hand, this ring 28 is stiff enough to support the contacting forces exerted by a contacting device 20 on the upper disk 14.

The flexible ring 28, in turn, must be supported directly or indirectly on the disk axis 13. For this purpose the disk axis 13 is provided with a bearing plate 36, on which the ring 28 could be supported. This would be the case if the disk brake 10 were to be constructed without a driving mechanism for cleaning the yarn. The ring 28 is, however, supported indirectly over a hollow bearing shaft 25, with which the lower disk 26 is to be rotated by way of ring 28. For this purpose, the bearing shaft 25 has a shaft end 25', which passes at right angles through the brake support 12. However, the hollow bearing shaft 25 is not supported directly upon the brake support 12, but is supported in a bearing recess 24, which is formed by an annular projection 42 of the bearing plate 36. This bearing recess 24 is expanded radially above the brake support 12 and within the bearing plate 36, so that the hollow bearing shaft 25 can accommodate the ring 28 with an external peripheral groove 25'', so that the ring 28 is at a radial distance from the adjacent bearing plate 36, relative to which it rotates.

A traversing rod 27, which is parallel to the support and can be moved back and forth as indicated by the double arrow 43, drives the hollow bearing shaft 25. The extent of the motion is such that the lower disk 26 rotates by more than 360°. Consequently, all abraded yarn parts are reliably wiped off and clumps cannot form in the region of the disks. Moreover, wear of the disk pair is prevented. With a length of toothed rack 27', the traversing rod 27 engages the gear tooth system 25'', of the hollow bearing shaft end 25' of FIG. 2.

Figure 1:
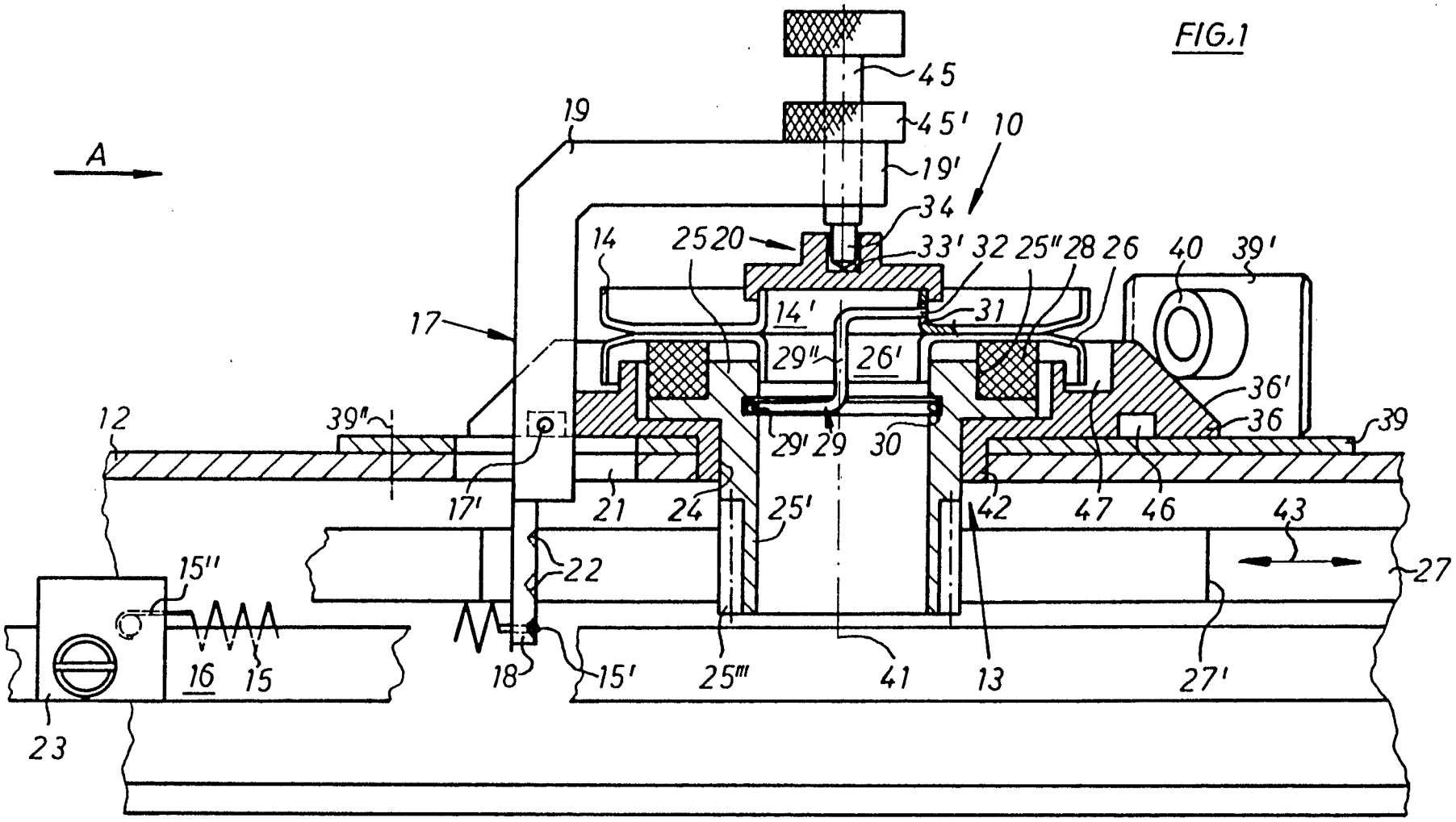
FIG. 1 shows a cross section through an inventive disk brake.

The driving mechanism of the bearing shaft 25 acts only on the lower disk 26. So that the upper disk 14 is also made to swivel back and forth to the same extent, a spring 29 is present, which is formed from a piece of wire. The one end 29' of the spring is open and ring-shaped and is seated flexibly and clamped in a groove 30 of an inner wall 44 of the hollow bearing shaft 25. The internal diameter of the hollow bearing shaft 25 is sufficiently large, that the inner disk edge, which projects radially in the direction of the brake support 12, can engage the bearing shaft 25. The other end 29'' of the piece of wire, to begin with, projects axially in the direction of the upper disk 14 and engages the inner recess 14' of the latter, where it is radially offset and projects radially into the region of the axial inner edge of the disk 14, where it engages with a radial section 32 a recess 31 of the disk 14 or of the annular inner edge of the disk. In FIG. 1, only a single recess 31 is shown as a borehole. It is, however, obvious that several recesses 31 can also be present as boreholes or as slots, in order to facilitate the assembly.

To produce a braking force, the upper disk 14 is pushed against the lower disk 26. A contacting device 20 is provided, which presses on the upper disk 14. The contacting device 20 consists essentially of a pressure plate 33, which is rigidly connected with the inner edge of the disk 14 and turns with this disk 14, if the latter is driven. A load is applied to the contact device 20 through the agency of a pressure pin 34, which engages a blind borehole 33' of the pressure plate 33, in which it can move relatively. Relative to the pressure plate 33, this pressure pin 34 is thus stationary and has the clearance for movement, which is required for a low-friction force transfer in the axial direction.

The pressure pin 34 is acted upon by a reversing lever 17 with a brake spring 15. The reversing lever 17 is constructed as a 2-arm lever, the swivel pin 17' of which is supported at the bearing plate 36, so that the reversing lever 17 is united with the whole of the disk axis, or axial alignment support assembly 13 into a structural unit. In FIG. 2, the reversing lever 17 is disposed in a radial slot 38 of the bearing plate 36. The swivel pin 17' of the reversing lever 17 is there and engages with its ends the side walls 37 of the radial slot 38. To support the swivel pin 17' of the reversing lever 17, the bearing plate 36 has on its outer surface facing the mounting plate 39 a mounting slot 46, into which the ends of the swivel pin 17' are pressed together with the assembly pieces, the details of which are not shown. After the bearing plate 36 and the mounting plate 39 are assembled, the assembly pieces cannot fall out again. As viewed from the swivel pin 17', the reversing lever 17 is a 2-arm lever with one lever arm 18, which passes through the mounting plate 39 and the brake support 12 with clearance for motion. For this purpose, the brake support 12 has a recess 21, which provides clearance for the motion. This clearance for the motion permits the lever arm 18 of FIG. 2 to be shifted into the two pivoting directions, particularly also in the event that the disk brake 10 is opened.

The other lever arm 19 is angular or V shaped. The one V leg extends in the direction of the lever arm 18 and the other V leg is disposed parallel to the brake support 12 and carries at its end 19' or a therein present tapped hole a regulating screw 45 with a lock nut 45'. The regulating screw 45 is able to raise or lower the pressure pin and, with that, bring about a fine adjustment of the compression force of the upper disk 14 on the lower disk 26 or on the yarn 1 1, depending on the buttressing power of the ring 28.

With one end 15', which is suspended in a spring-engaging site 22 of the arm 18, the brake spring 15, which is constructed as a tension spring, engages the arm 18. The other end 15'' of the spring 15 is attached to the adjusting ring 23, which is clamped to an adjuster 16, which is constructed as a rod. If the adjustability requirements of the braking force of a disk brake are less, the brake spring 15 can also be fastened directly to a brake support 12. The brake spring 15 can be tensioned more or less with the adjuster 16, so that a greater or lesser compression force can be exerted with the reversing lever 17 on the upper disk 14 or on the yarn 11. The adjuster 16 can be provided with several adjusting rings 23 for further disk brakes, so that a central adjustment for several disk brakes or for all disk brakes of a warp creel results.

The arm 18 of the reversing lever 17 protrudes at right angles to the adjusting direction of the adjuster 16 below the horizontal brake support 12 or into the horizontal region of motion of the adjuster 16 and has there several spring engagement sites 22. The distance from the swivel pin 17' of these spring engagement sites 22, which are constructed as notches, varies. Consequently, the braking force of the disk brake 10 varies. It is least in the top spring engagement site 22, because the lever arm is shorter there than elsewhere. Conversely, the braking force is at its highest level in the lowest spring engagement site 22. Consequently, yarn tension regions can be fixed or set independently of the possibility of making a fine adjustment of the disk brake with the regulating screw 45 and independently of the action of the adjuster 16 on the reversing lever 17, so that the disk brake can be designed for very small as well as for very large braking forces. This improves the universal suitability of the disk brake very appreciably.

The bearing plate 36 is raised to about the height of the disk gap 35, so that it can support the yarn 11 there, especially when it is in the tensionless state. At the same time, the bearing plate 36 is provided with a yarn sliding surface 36'; which extends as far as the vicinity of the mounting plate 39. The yarn sliding surface 36' can serve to ensure that a tensionless, possibly somewhat sagging yarn is pulled without entanglement into the disk gap 35 when winding is continued. At the same time, the bearing plate 36 also serves to protect the lower disk 26, which it embraces with the exception of a recess 36'', which makes the disk 26 accessible at the side. As a result of the recess 36'', the lint adhering to the edge of the disk 26 can be removed. Spacious, annular plate recesses 47 bring about that the outer edge of the lower disk 26, which projects axially in the direction of the brake support 12, can rotate without being impeded.

We claim:

1. A disk brake for textile yarns having an axial alignment support means disposed perpendicularly to a horizontal brake support of a warp creel with a lower braking disk and an upper braking disk, arranged and constructed to be adjustably loaded for adjusting the braking force, characterized in that, below the horizontal brake support, a brake spring i disposed parallel to and applies tension in a direction parallel to the brake support and engaging at one end the brake support through an adjuster that can be shifted relative to the brake support and on the other end a lever arm of a pivoted lever, arranged and constructed to bear vertically downwardly at the other end on the upper disk under the influence of the brake spring.

2. The disk brake of claim 1, characterized in that the pivoted lever is a 2-arm lever, one arm of which is engaged by the brake spring and the other arm of which presses at one end upon a contacting device disposed on the upper disk.

3. The disk brake of claim 2, characterized in that the one arm of the lever passes with clearance for motion through a recess of the brake support into the region of the brake spring, which is parallel to the brake support, and has there several spring-engaging sites.

4. The disk brake of claim 3, characterized in that the brake spring disposed parallel to the brake support is a tension spring.

5. The disk brake of claim 4, characterized in that brake spring is disposed with one end secured in a notch of the arm of the pivoted lever and with the other end secured to an adjusting ring which is clamped to an adjuster constructed as a rod parallel to the brake support.

6. The disk brake of claim 1, characterized in that the axial alignment support means is combined with the reversing lever into one structural unit mounted on the brake support.

7. The disk brake of claim 6, characterized in that, a swivel pin of the pivoted lever, which engages with its ends the side walls of a radial slot of a bearing plate of the axial alignment support means, serves to combine the axial alignment support means with the reversing lever into a combined structural unit.

8. The disk brake of claim 1, characterized in that a bearing plate lies on a mounting plate which can be assembled with the brake support and has yarn guides which are held at the height of intersection of the disks.

9. The disk brake of claim 1, characterized in that the bearing plate has a rotationally symmetrical bearing recess for an axially supported bearing shaft which carries the lower disk co-axially therewith and passes with one end of the shaft through the brake support which has a transversing rod which is parallel to the support and engages the shaft end.

10. The disk brake of claim 1, characterized in that a bearing shaft supports the lower disk with a resilient ring.

11. The disk brake of claim 10, characterized in that the bearing shaft incorporates a spring which engages the upper disk through a central recess of the lower disk and upper disk.

12. The disk brake of claim 11, characterized in that the spring comprises a piece of wire, one end of which is ring-shaped and inserted in a circumferential grove of the bearing shaft, and the other end of which protrudes parallel to the axis up to the upper disk which has at least one recess for engaging a radial section of the other end of the piece of wire.

13. The disk brake of claim 1, characterized in that the upper disk is rigidly connected to a pressure plate, which is engaged by a rotationally mobile pressure pin, which is fastened to the other end of the pivoting lever.

14. The disk brake of claim 13, characterized in that the effective length of the pressure pin is adjustable to vary the pressure on the upper disk.

15. The disk brake of claim 1, characterized in that a bearing plate embraces the outside of the lower disk to about level with the intersection of the disks.

16. The disk brake of claim 15, characterized in that a bearing plate has at its outer periphery a recess which facilitates access to the lower disk at the side.

17. The disk brake of claim 16, characterized in that the bearing plate has at its outer circumference, at least in the region of a pair of yarn guides, an inclined yarn sliding surface which extends from the height of the disk gap to the vicinity of mounting plate.

18. A disk brake for textile yarns with a disk axis disposed perpendicularly to a horizontal brake support of a warp creel and with an upper disk, which can be adjustably loaded for adjusting the brake force, characterized in that, below a horizontal brake support, a brake spring is disposed, which is parallel to and applies tension in a direction parallel to the brake support via an adjuster that can be shifted relatively to the brake support and, a lever arm of a pivotable, stationary reversing lever, which presses vertically on the upper disk under the influence of the brake spring and being further characterized by the reversing lever being a two-arm lever and wherein one arm of the reversing lever protrudes with clearance for motion through a recess in the brake support as far as into the region of the brake spring, which is parallel to the brake support, and has several spring-engaging sites.

19. The disk brake of claim 18, characterized in that the brake spring which is parallel to the support is a tension spring.

20. The disk brake of claim 19, characterized in that the brake spring is suspended with one end in a notch of the arm of the reversing lever and, with the other end at an adjusting ring, which is clamped to an adjuster which is constructed as a rod parallel to the support.

21. The disk brake of claim 18, characterized in that the disk axis is combined with the reversing lever into one structural unit, which is mounted on the brake support and a swivel pin of the reversing lever, which engages with its ends the side walls of a radial slot of a bearing plate of the disk axis, serves to combine the disk axis together with the reversing lever into a structural unit.

22. A disk brake for textile yarns and threads in a warping machine comprising:

(a) a pair of upper and lower opposed disks mounted substantially horizontally on a brake support, (b) the lower disk being resiliently supported upon a disk support upon the brake support, (c) the upper disk being at least in indirect contact with a pressure plate means, and (d) a pivoted lever arm arranged and constructed to have one end biased by spring means disposed adjacent one end with the opposite end of the lever disposed against the pressure plate means in contact with the upper disk, the spring means applying tension to the lever arm and thereby applying pressure to the pressure plate means.

23. A disk brake in accordance with claim 22 wherein the spring is a tension spring.

24. A disk brake according to claim 23 wherein means are provided for attaching the tension spring to the pivot arm at different points to adjust the leverage attained and transfer the force of the spring to the pressure plate against the upper disk.

25. A disk brake according to claim 24 wherein the lower disk is mounted for rotation of the lower disk by rotation of the disk support respective to the brake support overall.

26. A disk brake assembly according to claim 22 wherein the pivot arm has two sections extending at different angles form a central point allowing the spring to be disposed below the disk brake assembly.

27. A disk brake assembly according to claim 26 wherein the pivot of the lever arm is mounted upon the mounting of the upper and lower disks unitizing the assembly.

28. A disk brake according to claim 27 wherein the lower disk is mounted upon a resilient ring.

* * * * *